US006715249B2

(12) United States Patent
Rusek et al.

(10) Patent No.: US 6,715,249 B2
(45) Date of Patent: Apr. 6, 2004

(54) STRUCTURAL INSULATED SHEATHING AND RELATED SHEATHING METHODS

(75) Inventors: Stanley J. Rusek, Granville, OH (US); Ravi K. Devalapura, Columbus, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 10/107,571

(22) Filed: Mar. 27, 2002

(65) Prior Publication Data

US 2003/0041544 A1 Mar. 6, 2003

Related U.S. Application Data

(63) Continuation of application No. 60/279,162, filed on Mar. 27, 2001.

(51) Int. Cl.[7] ..... E04C 2/34

(52) U.S. Cl. ..... 52/481.1; 52/223.1; 52/309.1; 428/317.1; 428/537.1; 428/537.5; 428/105; 428/113

(58) Field of Search ..... 52/481.1, 223.1, 52/309.1; 428/317.1, 537.1, 537.5, 105, 113, 107, 112

(56) References Cited

U.S. PATENT DOCUMENTS

| | | | | |
|---|---|---|---|---|
| 3,979,867 A | | 9/1976 | Sowinski | |
| 4,434,601 A | * | 3/1984 | Zellmer | 52/745.13 |
| 4,563,851 A | | 1/1986 | Long | |
| 4,564,554 A | | 1/1986 | Mikuski | |
| 4,747,245 A | | 5/1988 | Lesmeister et al. | |
| 4,765,105 A | | 8/1988 | Tissington et al. | |
| 4,822,663 A | * | 4/1989 | Reott | 428/317.1 |
| 4,914,883 A | * | 4/1990 | Wencley | 52/732 |
| 4,937,993 A | | 7/1990 | Hitchins | |
| RE34,022 E | | 8/1992 | Davis | |
| 5,285,607 A | | 2/1994 | Somerville | |
| 5,345,738 A | | 9/1994 | Dimakis | |
| 5,352,510 A | | 10/1994 | Laughlin et al. | |
| 5,505,031 A | | 4/1996 | Heydon | |
| 5,701,708 A | | 12/1997 | Taraba et al. | |
| RE36,676 E | | 5/2000 | Sourtis | |
| 6,088,950 A | * | 7/2000 | Jones | 43/124 |
| 6,355,333 B1 | * | 3/2002 | Waggoner et al. | 428/174 |

FOREIGN PATENT DOCUMENTS

DE 40 18 762 A1 12/1991

OTHER PUBLICATIONS

The Mortar Net Drainage System; 04082/MOR; BuyLine 9976; USA.

* cited by examiner

*Primary Examiner*—Carl D. Friedman
*Assistant Examiner*—Nahid Amiri
(74) *Attorney, Agent, or Firm*—Inger H. Eckert; Stephen W. Barns; Maria C. Gasaway

(57) ABSTRACT

A structurally enhanced, insulating sheathing (10) and method of sheathing a frame of the type used in constructing a building are disclosed. In one embodiment, the sheathing includes an insulating layer of material (14) attached to a structural layer of material (12) formed of a plurality of fibers (12*al*–12*an*), preferably biased in first and second directions ($D_1$, $D_2$) relative to a common axis, such as the longest centerline of the sheathing. The fibers form a grid (12*c*) having a plurality of openings (12*d*) that are capable of receiving an adhesive ($A_3$) for attaching the sheathing to a stable mounting structure, such as a frame. Preferably, the adhesive is capable of penetrating at least partially into the openings to ensure that a secure, lasting bond is formed. In a second embodiment the sheathing includes a multilayer polymer film with a low melting point adhesive thereon.

23 Claims, 7 Drawing Sheets

STRUCTURAL INSULATED SHEATHING AND RELATED SHEATHING METHODS

TECHNICAL FIELD AND INDUSTRIAL APPLICABILITY OF THE INVENTION

The present invention relates generally to insulated sheathing for use in building construction or the like and, more particularly, to an insulated sheathing having enhanced structural properties.

BACKGROUND OF THE INVENTION

In constructing a building, and in particular a house, a relatively thin panel board of is commonly used to cover the structural framework of exterior walls. The board is typically fabricated from a low-cost, lightweight material having enhanced insulating properties, such as for example polystyrene or polyurethane foam. Usually, the boards are sized for use in conjunction with conventional frame sections (that is, frames with wooden studs on 16 inch (40.64 cm) or 24 inch (60.96 cm) centers). The boards may also have varying thicknesses and compositions, depending on, among other considerations, the desired resistance to heat flow. In the case of foams, additional layers of materials, called "facings," are also commonly laminated on or affixed to one or more of the surfaces to create a vapor barrier, increase the stiffness, durability, or resistance, as well as to possibly prevent the release of blowing agents.

While insulating boards fabricated solely of foam or the like provide the desired thermal insulation value, they simply do not have sufficient strength to resist the various wind and other racking type loads created in a typical building. For example, when secured to the frame using typical mechanical fasteners, such as nails or staples, the insulating material is unable to withstand the local tensile and compressive stresses created as the result of in-plane shear forces acting on the frame. The fasteners may tear the insulating panel. As a result, the loads are not controlled and the building integrity is compromised. To prevent this, a common practice is to install metal or wood braces on the boards to handle these loads. However, this increases the overall construction cost and effort required.

Another common practice is to attach a layer of plywood or oriented strand board (OSB) to the frame to provide the desired structural enhancement. However, neither plywood nor OSB provides the desired degree of resistance to heat loss. To maintain thermal integrity with this practice, a layer of insulation board may be placed on the plywood or OSB board. However, this practice significantly increases the overall cost of construction. Also, it increases the wall thickness to the point where special jamb extensions are required to finish out the wall.

In an effort to reduce construction costs without compromising the integrity of the resulting building, others in the past have proposed a reinforced insulating material in the form of a sheathing designed to eliminate the need for adding a separate structural layer, such as plywood, to the frame. For example, U.S. Pat. No. 5,345,738 to Dimakis discloses a structurally enhanced sheathing comprised of a layer of insulating foam in combination with opposing facing layers of a treated cellulosic (paper) material. While this composite sheathing is somewhat stronger than the foam insulation alone, there are shortcomings. First of all, the outer layers are essentially formed of paper, and thus may not provide the desired level of moisture imperviousness and strength. Additionally, forming and laminating facings comprised of several distinct layers add to the manufacturing expense. Of course, cost is a key consideration in the design of structural sheathing, since the builder is trying to keep costs as low as possible to not only increase profits, but also to remain competitive in the market.

Accordingly, a need is identified for an improved sheathing for use in insulating and strengthening a building or the like. The sheathing should be sufficiently strong to avoid the past need for attaching additional layers of wood or the like to the frame to provide at least a minimum level of structural enhancement. The sheathing should also be easy to manufacture at a relatively low cost, such that it results in a significant advance in terms of structural performance per unit cost as compared to prior art proposals.

SUMMARY OF THE INVENTION

A structurally enhanced sheathing for use in insulating a building or the like is disclosed. The structural enhancement comes from the use of a structural layer of material in conjunction with an insulating layer of material. The structural material may comprise a plurality of fibers extending in first and second biased directions, and thus, defining a grid having a plurality of openings. The openings are capable of receiving an adhesive for attaching the sheathing to a stable mounting structure, such as a wall frame. Preferably, the fibers forming the structural material are biased relative to a common axis, such as a centerline of the insulating material. Alternatively the structural material may be formed of a polymer film. Preferably the polymer film is a multilayer film adding sufficient mechanical properties to the insulating layer.

In accordance with a first aspect of the present invention, a sheathing for insulating and structurally enhancing a stable mounting structure is provided. The sheathing comprises a first layer of insulating material and a second layer of structural material attached to the insulating material. The structural material includes a plurality of fibers extending in first and second biased directions such that the fibers form a grid having a plurality of openings for receiving a first adhesive for securing the sheathing to the stable mounting structure.

In one embodiment, the insulating material may be selected from the group consisting of extruded polystyrene foam, expanded polystyrene foam, polyurethane foam, polypropylene foam, polyisocyanate foam, polyisocyanurate foam, and combinations thereof. However, it is also possible to form the insulating material of wood, paper, waxed cardboard, and combinations thereof. The insulating material is usually in the form of a rectangular board, but can be of any shape, such as a square, circle, or the like.

To enhance the ability of the structural material to withstand tensile stresses acting on the wall frame to which the sheathing is attached, the fibers may be oriented at any included angle between 0 and 90 degrees. Preferably, the fibers are oriented at first and second biased directions at an included angle of substantially 30 to 60 degrees relative to a common axis, such as a centerline of the insulating material (preferably the longest centerline, such that in the case of a rectangular sheathing, the fibers span from the top corner at one side to the opposite, bottom corner). Double-biasing the fibers at a 45-degree angle relative to a common axis, such as the centerline, is preferred for the majority of building applications. However, the angles of each direction may be different (for example, the first direction is 35 degrees and the second direction is 55 degrees), or the fibers extending in the same direction may be oriented at different angles, depending on the particular types of loading encountered or the degree of racking strength required for a particular application.

Each fiber is preferably comprised of a material selected from the group consisting of glass fibers, polymer fibers, carbon fibers, natural fibers, mineral fibers, metals, polymer films or tapes, or combinations thereof. The fibers may be singular or may be divided into a plurality of bundles or strands. In the case of polymers, the fibers may consist of polyester, nylon, polypropylene, poly-paraphenylene terephthalamide, and other low-elongation polymers. Also, it should be appreciated that the fibers in each plurality may be of different types, weights, lengths, or comprised of different materials in order to meet the anticipated racking load resistance requirements. Preferably, the fibers are continuous or elongated, but it is also possible to use random length, non-continuous fibers.

The selected fibers may be interwoven, layered, or stitched at the proper orientation. In any case, to hold the fibers together during the manufacturing process, an appropriate chemical binder, such as polyvinyl acetate (PVA), may be used as a stabilizer. An alternate manner of creating a fabric from the fibers is to weave them together and bind them to a stabilizing layer, such as a polymer film, using an adhesive, such as a hot melt, pressure sensitive adhesive. The opposite side of the stabilizing layer is then attached or adhered to the corresponding surface of the insulation layer such that the openings in the grid defined by the fibers face outwardly, thereby permitting them to contact the frame in the installed position. As should be appreciated, the stabilizing layer may also add to the racking strength of the resulting structural insulating sheathing.

An optional facing may also be provided for attachment to a substantially planar face of the insulating material opposite the face for receiving the structural material. The facing may include a first layer of polyester film, a second layer of polyester scrim, and a third layer of polyester film. A third adhesive may also be provided for attaching the facing to the insulating material. Additional layers may also be added, as necessary, to farther enhance the sheathing, such as in terms of enhancing the bending strength, stiffness, or thermal resistance.

In accordance with a second aspect of the invention, a sheathing for insulating and structurally enhancing a stable mounting structure is disclosed. The sheathing comprises a first layer of insulating material and a second layer of structural material attached to the insulating material. The structural material includes a plurality of fibers extending in first and second biased directions and thus forming a grid. The structural material further includes a stabilizing layer positioned between the fibers and the insulating material. Preferably, the stabilizing layer is a film, and the plurality of fibers are attached to a first side of the film, while and a second side of the film is attached to the insulating material. This stabilizing layer thus not only serves to hold the fibers in the desired orientation prior to, during, or after attachment of the structural layer to the insulating layer, but also may serve to further enhance the strength of the sheathing.

In accordance with a third aspect of the present invention, an assembly for insulating and structurally enhancing a frame of the type used in constructing a building or the like is provided. The assembly includes a multi-layer sheathing including a first layer of insulating material attached to a second layer of structural material. The structural material comprises a plurality of fibers forming a grid having a plurality of openings. An adhesive is also provided for securing the grid to the frame.

The fibers preferably project in first and second biased directions, with the grid thus formed being regular or irregular depending on the relative angles selected. The adhesive is preferably capable of at least partially penetrating into the openings in the grid and at least partially filling any gaps in a corresponding frame member. Alternatively, the adhesive may be an adhesive tape or any other adhesive substance capable of at least partially penetrating into the openings in the structural material and at least partially filling any gaps in a corresponding frame member. In one embodiment, the fibers are comprised of a material selected from the group consisting of glass fibers, polymer fibers, carbon fibers, natural fibers, mineral fibers, metals, polymer films or tapes, or combinations thereof. Also, it is possible to form the structural material from a plurality of chopped fibers.

In accordance with a fourth aspect of the present invention, a method of insulating and structurally enhancing a frame is disclosed. The method comprises providing a multi-layer sheathing including a first layer of insulating material and a second layer of structural material, the structural material including a plurality of fibers defining a grid having a plurality of openings and attaching the sheathing to the frame with the grid exposed and facing the frame. In a preferred embodiment, the attaching step includes providing a foaming adhesive for securing the sheathing to the frame. The foaming adhesive may be a quick-curing adhesive placed on the frame at the construction site (or the cure time may be altered to suit the factory environment), and a plurality of mechanical fasteners or clamps may be used to hold the sheathing in place on the frame while the adhesive cures. The plurality of fibers are preferably double biased at an included angle of 45 degrees relative to a common axis, such as the centerline of the sheathing, and the method includes orienting the structural insulated sheathing prior to application. In the case of a rectangular sheathing, the orientation is such that the fibers extend in a diagonal fashion, essentially from adjacent to a top corner to adjacent to the opposite bottom corner. Upon application to the frame, this orientation ensures that the desired resistance to shear loading is created.

In accordance with a fifth aspect of the present invention, a method of manufacturing a structurally enhanced, insulated sheathing, is disclosed. The method comprises providing a first layer of a structural material including a plurality of fibers defining a grid having a plurality of openings and a stabilizing layer for holding the fibers in place. The stabilizing layer not only serves to hold the fibers in the desired orientation prior to, during, or after attachment of the structural layer to the insulating layer, but also may serve to further enhance the strength of the sheathing.

In accordance with a fifth aspect of the present invention, a sheathing for insulating and structurally enhancing a stable mounting structure is provided. The sheathing comprises a first layer of insulating material and a second layer of structural material attached to the insulating material. The structural material includes a multiplayer film of PE, EVA and PET. In a preffered embodiment the film incorporates a tri-layer extruded film (LLDPE/LLDPE/EVA) which is glued to a second film (PET). The composite film is then heat sealed to both sides of an extruded polystyrene insulation panel using an in-line hot roll lamination process.

BRIEF DESCRIPTION OF THE DRAWING FIGS

Figure 8:
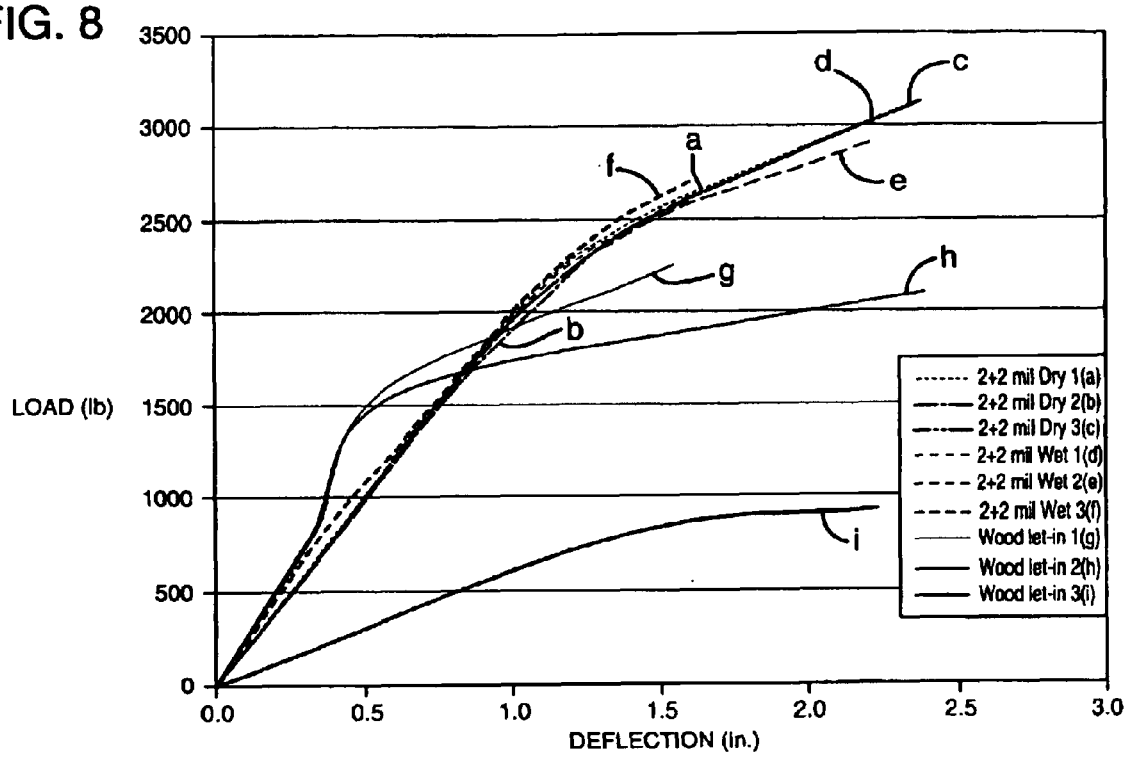

FIG. 8 graphically illustrates the results of a racking strength test experiment data of the structural insulated sheathing of the present invention using a polymer film structural material.

DETAILED DESCRIPTION AND PREFERRED EMBODIMENTS OF THE INVENTION

Figure 1:
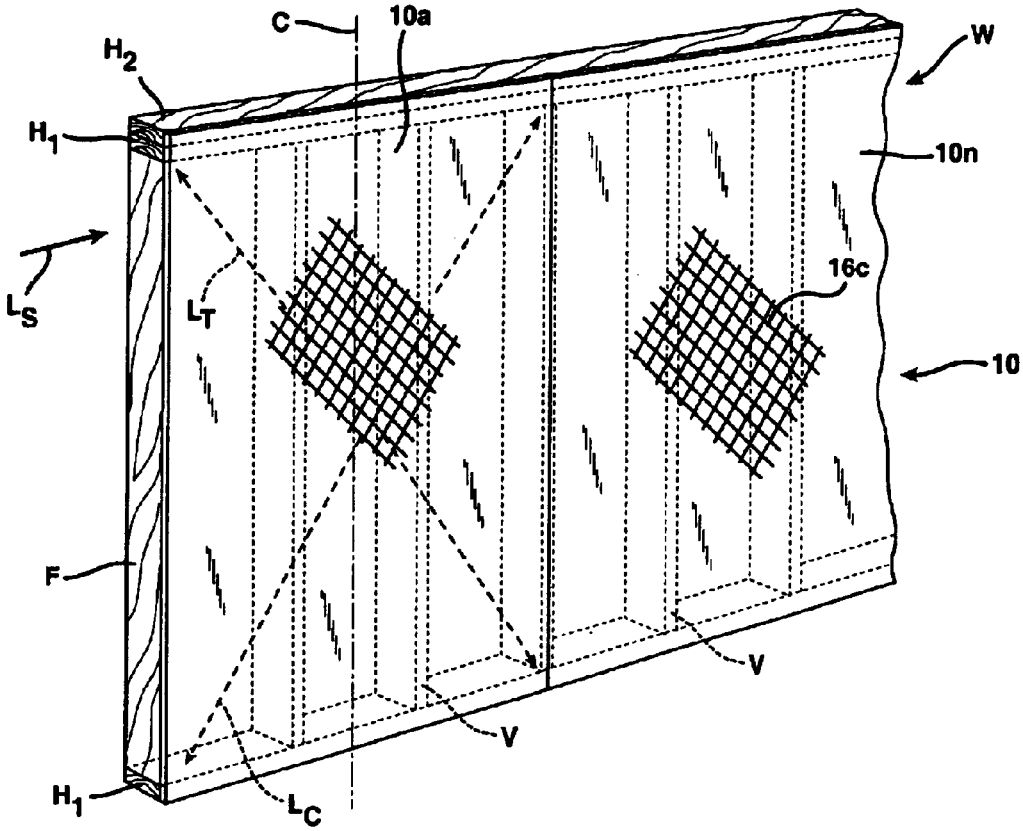
FIG. 1 is a partially cutaway, perspective view of a sheathing attached to a frame.

Reference is now made to FIG. 1, which illustrates a structural insulated sheathing 10 constructed in accordance with the present invention attached to a frame F of the type typically used to form at least a section of the outer wall W of a building, such as a house. The sheathing 10 is shown in the form of individual panels 10*a* . . . 10*n*, each sized and shaped to cover a certain portion of the frame F (for example, 4 foot (1.2 meter)×8 foot (2.4 meter)). The frame F is shown as being constructed of elongated wood members, such as "two by-four"or "two-by-sixes," with the vertical frame members V or "studs" being spaced at 16 inch (40.64 cm) centers along the substantially parallel upper and lower horizontal frame members $H_1$. Thus, a 4 foot (1.2 meter)×8 foot (2.4 meter) panel spans approximately four centers of the vertical members V. As shown, the top horizontally extending frame member $H_1$ may be reinforced with a second such frame member $H_2$ to provide an enhanced resistance to shear loading, as can the outermost vertical members in the frame (double stud arrangement not shown). Typically, the frame members V, $H_1$, $H_2$ and others are held together by mechanical fasteners, such as nails, screws, or the like, and may also be reinforced using metal brackets or other types of braces. As should be appreciated, the frame F may be constructed of materials other than wood, or of combinations of wood and other materials. Also, the frame F may be structurally arranged in any manner necessary to provide the desired strength for the particular building.

Figure 2:
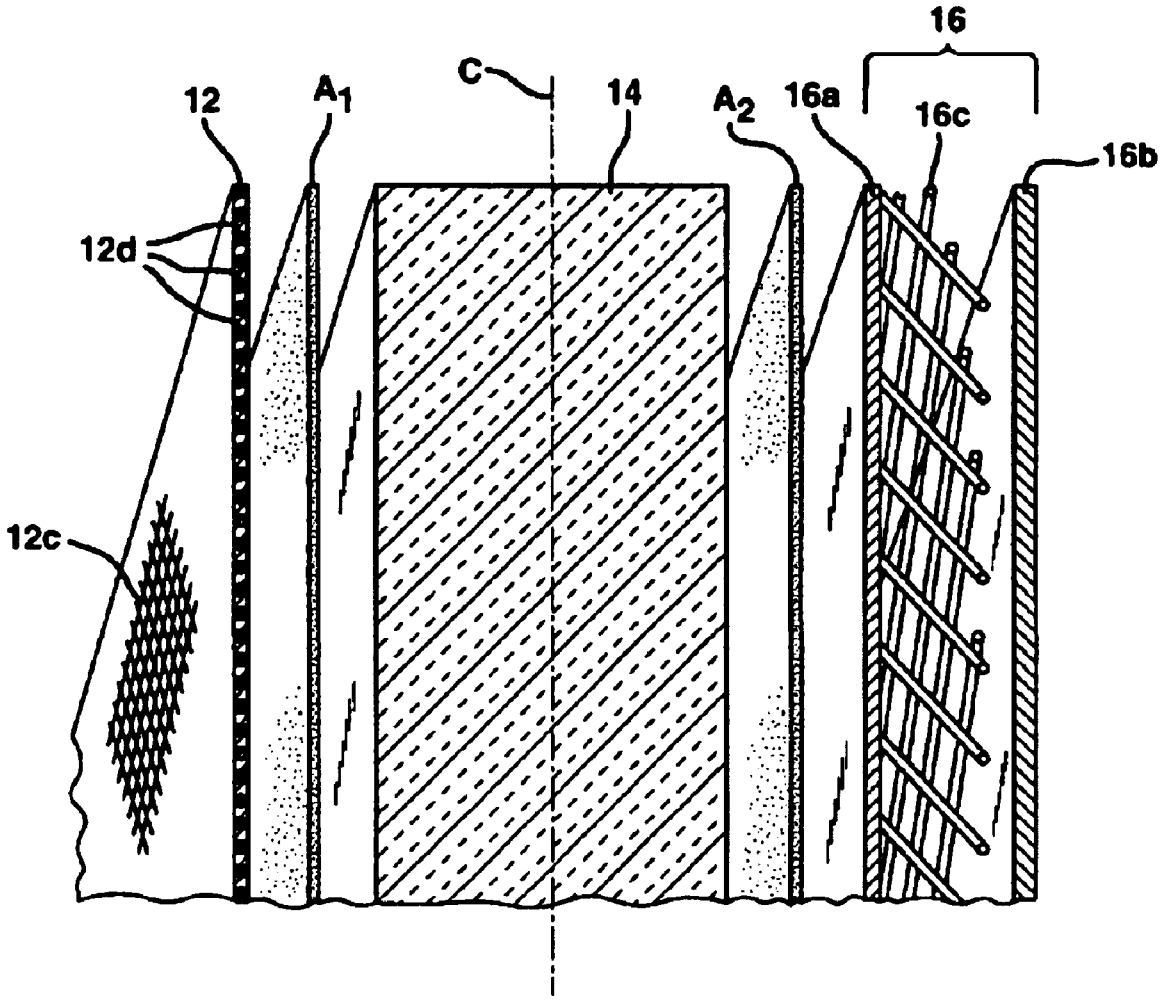
FIG. 2 is an exploded cross-sectional view of one embodiment of the sheathing of the present invention, including an optional facing.
Figure 5:
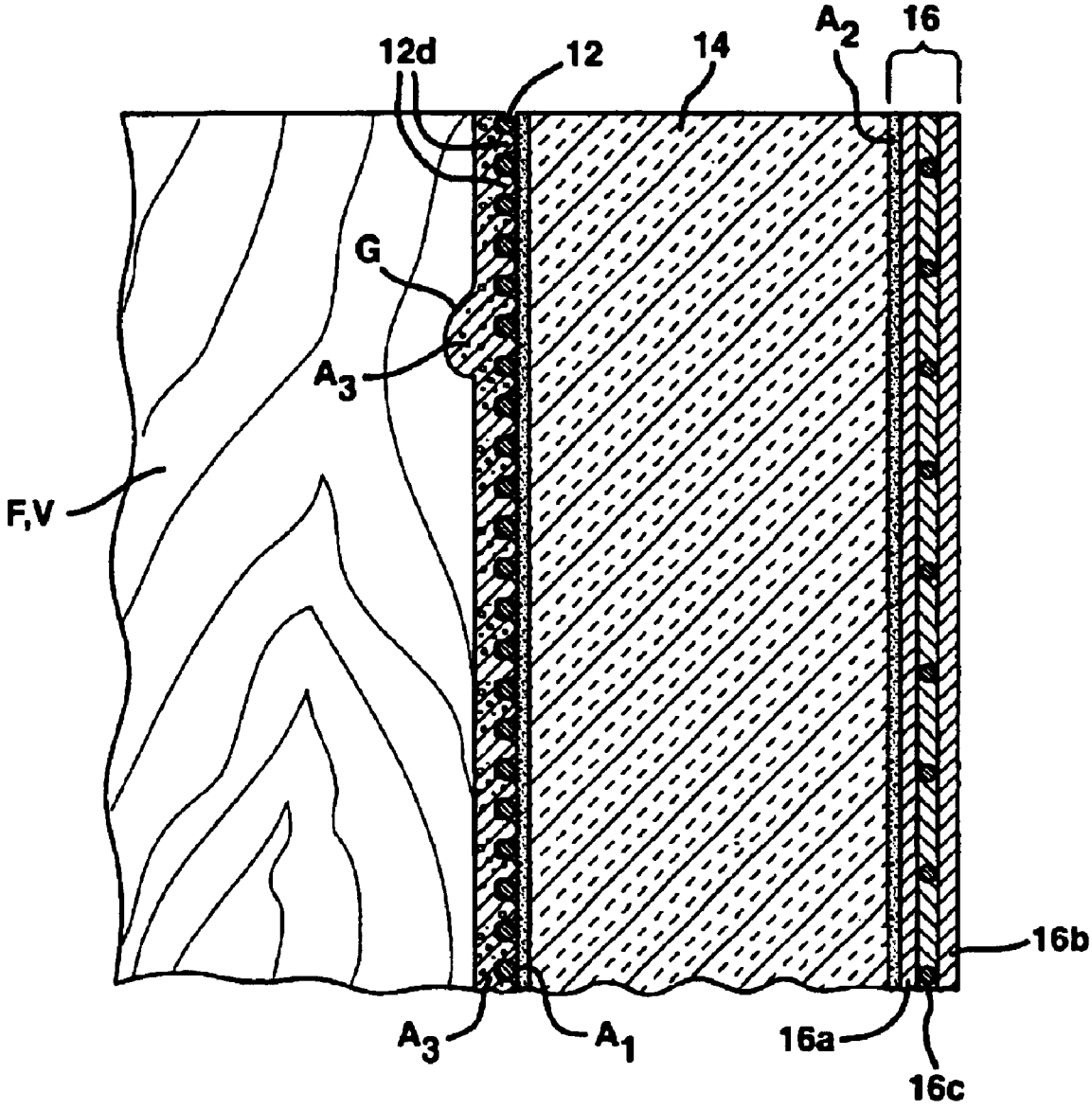
FIG. 5 is a cutaway cross-sectional view of the sheathing attached to one of several vertical members or studs forming the frame.

As shown in the exploded view of FIG. 2, as well as in the cross-sectional view of FIG. 5, the sheathing 10 of the present invention includes a structural layer of material 12, an insulating layer of material 14, and an optional facing 16. Taking each layer in turn, the structural material 12 is comprised of a plurality of fibers or alternately by a polymer film. The plurality of fibers may be individual fibers or other slender, thread like pieces of material, but are preferably either continuous individual glass rovings and/or polymer fibers grouped into rovings, bundles, threads, strands 12*al* . . . 12*an* or the like. In either case, the fibers or strands of fibers 12*al* . . . 12*an* project in first and second biased directions $D_1$ and $D_2$ and thus form a fabric (which is not necessarily woven, as described further below). Despite the preference for using homogeneous strands 12*al* . . . 12*an* of either glass or PET fibers, it is within the broadest aspects of the invention to form the structural material 12 of different combinations of fibers (whether grouped or divided into strands or not), a mat of stabilized or bound chopped fibers (not shown), or any other fabric-like material comprised of a plurality of fibers projecting in different biased directions and meeting the other criteria outlined in the description that follows.

Figure 3:
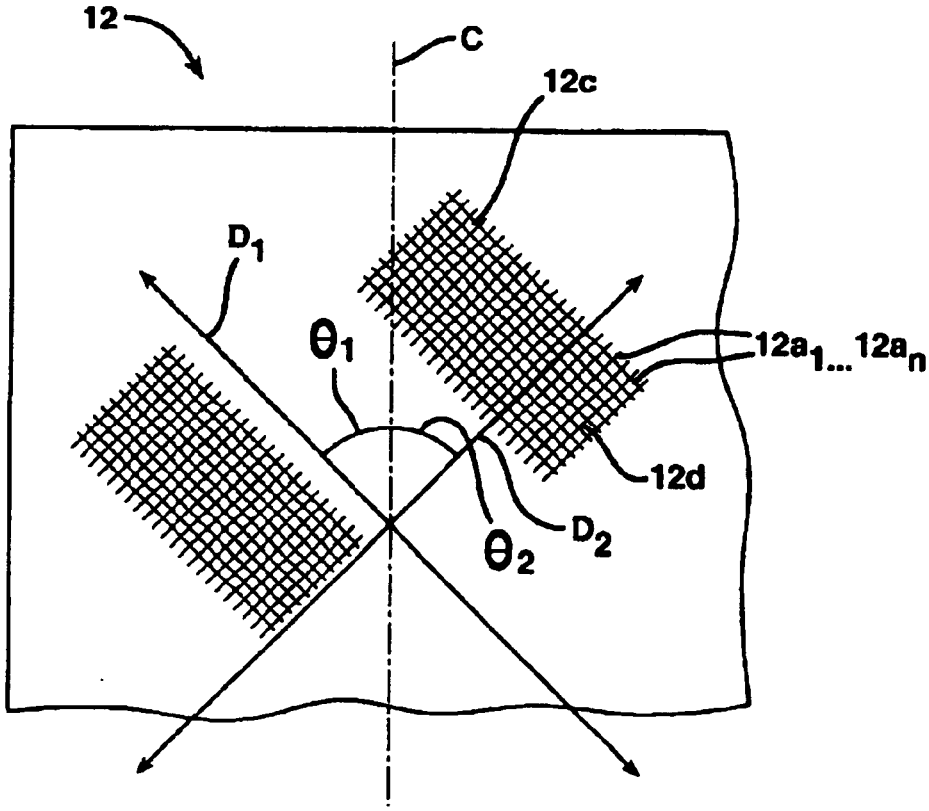
FIG. 3 is a cutaway elevational view of the side of the sheathing carrying the structural material.

Preferably, the fiber strands 12*al* . . . 12*an* extending in the first direction $D_1$ are parallel to each other and spaced apart, and the strands 12*al* . . . 12*an* extending in the second direction $D_2$ are likewise parallel to each other and spaced apart. As a result of this arrangement, the strands 12*al* . . . 12*an* form a grid 12*c* having a plurality of openings 12*d*. As perhaps best shown in FIG. 3, the first and second directions $D_1$, $D_2$ are "biased," which means that each is oriented at an angle $\theta_1$, $\theta_2$ relative to a common axis, which is illustrated as the centerline C of the insulation material 14. Preferably, each angle is an included angle (for example, an angle formed between the vertical centerline C of the sheathing 10 perpendicular to a horizontal axis) of between 30 degrees and 60 degrees, and most preferably approximately 45 degrees. The angles $\theta_1$, $\theta_2$ may be the same to form a regular grid 12*c*, as depicted, or may be at different angles (that is, the fibers or strands 12*al* . . . 12*an* projecting in a first direction may extend at a first included angle, $\theta_1$ (for example, 35 degrees), while those extending in the second direction extend at a second included angle, $\theta_2$ (for example 55 degrees). Also, the strands 12*al* . . . 12*an* or individual fibers may extend at different included angles in the same direction or have different spacings, both of which may create an irregular grid (not shown). Varying the angles is possible as necessary to apply the primary strength of the fabric thus formed substantially parallel to the developed tensile racking forces acting on the wall frame.

As briefly mentioned above, the fibers forming the strands 12*al* . . . 12*an* are preferably glass fibers or rovings, PET polymer fibers or filaments, or combinations thereof.

When combinations of fibers are used, the minimum quantities of each maybe dictated by the lowest cost construction, as well as other criteria, such as fire performance or the like. Exemplary materials for forming the strands 12*al* . . . 12*an* include interwoven "double biased" continuous strands of PET or glass fibers projecting at substantially 45 degrees relative to a common axis are manufactured and distributed by Burlington Industries, Chavanoz Industrie, DuPont and the Assignee of the present invention. Instead of glass or PET fibers, the use of other types of materials is also possible. For instance, the strands 12*al* . . . 12*an* could be formed of carbon fibers, natural fibers, mineral fibers, other polymer fibers (for example, nylon, polypropylene, poly-paraphenylene terephthalamide (KEVLAR)), or other types of low-elongation materials that enhance the strength of the sheathing 10. Also, instead of forming strands 12*al* . . . 12*an* from a plurality of glass or polymeric fibers, elongated pieces of metal, such as steel or aluminum, could be used. Alternatively, the fibers may be slender, thread like strips of a polymer film or tape (such as strips of a thermal shielding product sold under the PINK-WRAP trademark by the Assignee of the present invention). Combinations of these materials, or other types of composite materials, may also be employed to create a hybrid structural material layer. The selected fibers or combinations of fibers may optionally be treated or undergo further processing to enhance their structural properties (that is, through lamination, coatings, etc.). Indeed, the particular fibers or coatings may be selected to enhance the properties of the resulting structural layer 14, such as in terms of strength, fire resistance, or the like. Also, instead of interweaving the strands 12*al* . . . 12*an* or the fibers, they may be layered such that those projecting in a first direction $D_1$ extend in a different parallel plane and simply overlie those projecting the second direction $D_2$.

Fibers or strands of fibers projecting in third and fourth directions (for example, 0 degrees and 90 degrees) may also be interlaced or intermeshed with the double biased fibers for added strength, as long as the openings 12*d* remain in the grid 12*c* thus formed. The fibers extending in different directions may also be fabricated of different materials or different sizes/weights of the same material. The structural material 12 may also be formed such that different numbers or types of fibers extend in different directions.

To ensure that the fibers or strands 12*al* . . . 12*an* forming the structural layer of material 12 maintain the desired orientation relative to each other prior to installation, it is possible to coat these fibers or stands with an appropriate chemical binder, such as polyvinyl acetate (PVA), which may create a stabilizing layer. This binder serves to hold the fibers or groups of fibers forming strands 12*al* . . . 12*an* in the proper orientation prior to lamination on the insulating material 14. Alternatively, and as described in detail below, a film may serve as the stabilizing layer.

In an alternative embodiment a multiplayer polymer film may be used as the structural layer of material 12 affixed to the insulating layer of material 14 and optional facing 16. Taking each layer in turn, the structural material is formed of a multiplayer polymer film in this invention incorporates multiple layers of linear low density polyethelene (LLDPE), at least on layer of ethylvinylacetate (EVA) and polyethylene terephthalate (PET). Preferably a coectruded multilayer extruded film is adhered to a second film having a melting point lower than the melting point of the tri-layer film. The films used in Examples 1–6 is formed of a coextruded trilayer 0.0012 inch (0.0030 cm) LLDPE/LLDPE/EVA film adhered to a relatively lower melting point 2 mil PET. The composite film is then heated and laminated to both sides of an extruded polystyrene insulation panel using an in-line hot roll lamination process. The results of ASTM E72 Cyclic Testing of the several samples are in Tables 1–3 and are used to generate the Graph of FIG. 8. The ASTM E-72 racking test requires the sheathing product to be tested in two different conditions. One is standard laminated sheathing at room temperature (Table 1) and the other after cycling the specimen in a water spraying chamber of wet & dry cycles for 3 days (Table 2).

In EXAMPLES 1–3, 0.50 inch (1.27 cm) FOAMULAR Brand Insulation (Available from Owens Corning) was laminated to a 0.0012 inch (0.0030 cm) LLDPE/LLDPE/EVA film with a 2 mil PET film on both sides. The structural member 10 was then glued to the frame using Henkel 8225 adhesive (160 gm). The Load and Deflection are shown in Table 1 (Below).

| EXAMPLE 1 | | EXAMPLE 2 | | EXAMPLE 3 | |
|---|---|---|---|---|---|
| Load (lb) | Deflection (in.) | Load (lb) | Deflection (in.) | Load (lb) | Deflection (in.) |
| 0 | 0 | 0 | 0 | 0 | 0 |
| 790 | 0.411 | 790 | 0.411 | 790 | 0.4085 |
| 0 | 0.0325 | 0 | 0.014 | 0 | 0.018 |
| 1570 | 0.785 | 1570 | 0.806 | 1570 | 0.7825 |

-continued

| EXAMPLE 1 | | EXAMPLE 2 | | EXAMPLE 3 | |
|---|---|---|---|---|---|
| Load (lb) | Deflection (in.) | Load (lb) | Deflection (in.) | Load (lb) | Deflection (in.) |
| 0 | 0.0165 | 0 | 0.017 | 0 | 0.0175 |
| 2360 | 1.265 | 2360 | 1.3005 | 2360 | 1.3179 |
| 0 | 0.0255 | 0 | 0.0215 | 0 | 0.0304 |
| 3000 | 2.1785 | 3420 | max | 3130 | 2.39 |
| 3170 | max | | | 3200 | max |

In EXAMPLES 4–6, 0.50 inch (1.27 cm) FOAMULAR Brand Insulation (Available from Owens Corning) was laminated to a 0.0012 inch (0.0030 cm) LLDPE/LLDPE/EVA film with a 2 mil PET film on both sides. The structural member 10 was then glued to the frame using Henkel 8225 adhesive (160 gm). The Load and Deflection are shown in Table 2 (Below).

| EXAMPLE 4 | | EXAMPLE 5 | | EXAMPLE 6 | |
|---|---|---|---|---|---|
| Load (lb) | Deflection (in.) | Load (lb) | Deflection (in.) | Load (lb) | Deflection (in.) |
| 0 | 0 | 0 | 0 | 0 | 0 |
| 790 | 0.414 | 790 | 0.407 | 790 | 0.354 |
| 0 | 0.0375 | 0 | 0.0205 | 0 | 0.0145 |
| 1570 | 0.772 | 1570 | 0.8035 | 1570 | 0.788 |
| 0 | 0.0035 | 0 | 0.015 | 0 | 0.0205 |
| 2360 | 1.2765 | 2360 | 1.2875 | 2360 | 1.2395 |
| 0 | 0.0305 | 0 | 0.0404 | 0 | 0.02 |
| 3051 | 2.2755 | 2913 | 2.2346 | 2703 | 1.602 |
| 3130 | max | | | 3300 | max |

EXAMPLES 7–9, 0.50 inch (1.27 cm) FOAMULAR Brand Insulation (Available from Owens Corning) was nailed to a wood frame including a let-in-brace. Wood-let-in specimen does not include the films present in examples 1–6. Examples 7–9 are made of a standard frame with 2 foot (0.61 meter)×4 foot (1.2 meter) at 16 inch (40.64 cm) on center with 1 foot (0.3 meter)×4 foot (1.2 meter) attached diagonally in a 8 foot (2.4 meter) by 8 foot (2.4 meter) frame. The studs of the frame are notched (1 inch (2.54 cm) deep) so that the 1 foot (0.3 meter)×4 foot (1.2 meter) wood let-in is flush with the frame surface to accept the exterior sheathing. The Load and Deflection are shown in Table 3 (Below).

| EXAMPLE 7 | | EXAMPLE 8 | | EXAMPLE 9 | |
|---|---|---|---|---|---|
| Load (lb) | Deflection (in.) (In Compression) | Load (lb) | Deflection (in.) (In Tension) | Load (lb) | Deflection (in.) (In Compression) |
| 0 | 0 | 0 | 0 | 0 | 0 |
| 790 | 0.3195 | 790 | 1.383 | 790 | 0.332 |
| 0 | 0.0895 | 0 | 0.7335 | 0 | 0.129 |
| 1570 | 0.627 | 920 | 2.2275 | 1570 | 0.565 |
| 0 | 0.1155 | | | 0 | 0.0725 |
| 2100 | 2.3925 | | | 2250 | 1.55 |

Turning now to the insulation, the material 14 forming this layer may be selected from the class of well-known insulating materials, with a preference for those that are relatively inexpensive and have enhanced resistance to thermal conductivity per unit of weight. In the most preferred embodiment, as illustrated, the insulation material 14 is extruded polystyrene, different versions, sizes and thicknesses of which are distributed by the Assignee of the present invention under the FOAMULAR trademark. However, the use of other foams is possible, such as expanded polystyrene foam, polyurethane foam, polypropylene foam, polyisocyanate foam, polyisocyanurate foam, and combinations thereof. Instead of foam, it is also possible to use cellulosic materials, such as wood (for example, plywood or OSB), paper, or waxed cardboard as the insulating material 14, depending on the desired amount of thermal resistance and the cost considerations associated with a particular construction. As should also be appreciated, the thickness of the insulating material 14 chosen for a particular construction depends primarily on the desired degree of thermal resistance. This is especially true when foam insulating materials are used, where slight increases in thickness may result in a significant increase in thermal resistance.

As illustrated, the insulating material 14 may have first and second substantially planar faces, one of which receives the structural material 12. To attach the structural layer of material 12 to the substantially planar face of the insulating material 14, an adhesive is preferably used, which is illustrated as layer $A_1$ in FIGS. 2 and 5. In a preferred embodiment, this adhesive $A_1$ is a dry adhesive, such as EVA (ethylene vinyl acetate), that is heat-activated during an in-line manufacturing process, as explained in more detail in the description that follows. Preferably, the plurality of openings 12*d* formed in the grid 12*c*, whether regular or irregular, extend completely through the structural material, and thus are capable of receiving the adhesive $A_1$ to ensure that a strong bond is formed. Alternatively, and especially in the case of an irregular grid, a layered grid, or where chopped fibers are used, the openings 12*d* on a first side of the structural material 12 may not necessarily be coextensive with any openings on the side receiving the adhesive $A_1$. Thus, these truncated openings may only partially receive the adhesive $A_1$. Also, it is possible to form the structural material 12 having a grid 12*c* such that openings 12*d* are provided only on the side for engaging the outer surfaces of the frame F, with the opposite side being substantially planar for engaging the corresponding surface of the insulating material 14.

Figure 4:
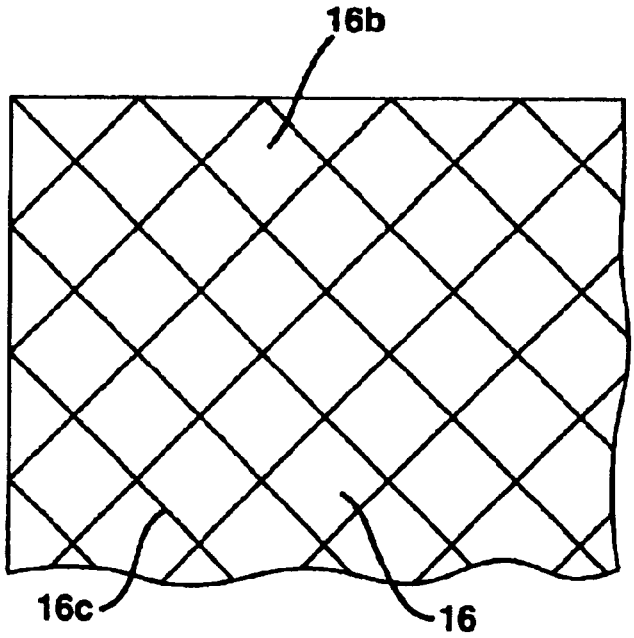
FIG. 4 is a cutaway elevational view of the side of the sheathing carrying the facing.

As perhaps best shown in FIG. 2, an optional facing 16 may also be applied to the substantially planar face of the insulating material 14 opposite the face that receives the structural layer of material 12. In the illustrated embodiment, the facing 16 includes first and second layers of a thin film 16*a*, 16*b*, such as a linear low density polyethylene (LLDPE) film 16*a* and a polyester film 16*b*, with a layer of scrim 16*c*, such as polyester scrim, interposed therebetween. The polyester scrim 16*c* is shown having a plurality of fibers or strands projecting at first and second biased directions (preferably, but not necessarily, 45 degrees to a common axis, such as the centerline of the insulating material 14, see FIGS. 1 and 4). The criss-cross grid or pattern formed by the scrim 16*c* may provide enhanced crush resistance so as to potentially prevent a blunt object, such as the foot of a worker, from penetrating through the sheathing 10 when it is resting on the ground prior to installation. The film layers 16*a*, 16*b*, on the other hand, serve as barriers against the passage of vapor and moisture, and may also be treated to provide enhanced fire resistance. One example of a suitable facing 16 is found on both sides of the PROPINK insulated sheathing distributed by the present Assignee, but it is again noted that even the single facing 16 proposed in the present sheathing 10 is considered optional, since it does not provide any significant structural enhancement. The facing 16 is secured to the substantially planar face of the insulating material 14 preferably using a second adhesive $A_2$, which may be EVA or any other known type of adhesive.

The method of installing the sheathing 10 on a stable mounting structure, such as the frame F, and the resulting assembly will now be described in detail. The sheathing 10 assembled in one of the various manners described above is selected having the desired degree of thermal conductivity/resistance and a dimension corresponding to the desired area of coverage of the frame F (but it is also of course possible to simply cut the sheathing as necessary to cover a particular area). The sheathing 10 is then oriented such that the fibers or strands 12*al* . . . 12*an* run from adjacent to one top corner of the frame F to adjacent the opposite corner of the frame. In the case of a rectangular sheathing 10 that covers a frame F of the type described above, this essentially means that the vertical centerline C of the sheathing 10 is substantially parallel to the centerline of the corresponding vertical member V or stud of the frame F (typically at 90 degrees relative to the horizontal plane), which is usually substantially perpendicular to the centerline of the horizontal member $H_1$ (typically at 0 degrees relative to the horizontal plane). The sheathing 10 is also oriented such that the grid 12*c* faces the outer surface of the members forming the frame F. As should be appreciated, in the case of a regular grid 12*c* constructed in accordance with the most preferred embodiment, the plurality of spaced strands 12*al* . . . 12*an*, each comprised of a plurality of fibers, are thus oriented at a 45 degree double bias relative to the centerline C and the vertical center axis of the studs V.

Next in the preferred installation method, an adhesive $A_3$ is applied to the frame members V, H that will underlie the grid 12*c* of the structural material 12. In the case of a frame F of the type described above, the adhesive $A_3$ is preferably applied to the lower horizontal member $H_1$, the upper horizontal members $H_1$, $H_2$, and the four substantially parallel vertical frame members V. Adhesive $A_3$ is preferably applied in a continuous line or bead to the faces of the members V, $H_1$, $H_2$, making direct contact with the structural material 12. The adhesive $A_3$ is most preferably a freely or partially foaming, gap filling, one component methylene phenylene diisocyanate (MDI) based urethane adhesive, a version of which is distributed under the PROBOND trademark by the Borden Corporation. Upon placing the sheathing 10 against the frame F, the foaming adhesive $A_3$ forms a layer (shown oversized in FIG. 5 for purposes of illustration) and penetrates at least partially into the openings 12*d* formed in the grid 12*c* to ensure that a strong bond is formed. Advantageously, the foaming adhesive $A_3$ is also capable of penetrating or filling any gaps in the frame members (for example, knots, holes, splits, or gashes in wooden members; see, for example, the adhesive $A_3$ substantially filling gap G in the vertical stud in FIG. 5), as well as to fill any void possibly created when the members are slightly bowed or their outer surfaces are otherwise not substantially planar.

Many other types of one-component MD-based urethane adhesives may also be used as adhesive $A_3$, including but not limited to: Ashland #HW 200 #4020D, or PLIODECK; Henkel #UR8225BHS, #UR8224S, #UR8228H, or #UR8225BHW; or GORILLA Glue, which is distributed in the United States by Lutz File & Tool Co. of Cincinnati, Ohio. As should be appreciated, other types of adhesives may also work, including possibly two-component MDI base urethane adhesives, gums, resins (thermosetting or two-part epoxy), hot melt adhesives, water-based PVA glues, pressure sensitive foam or other adhesive tapes, or like materials. The chosen adhesive should be capable of at least partially filling the openings 12*d* in the grid 12*c*, as well as possibly filling any gaps G in the frame members.

When the assembly of the sheathing 10 to the frame F is completed in a factory setting, the curing time of the adhesive $A_3$ is not necessarily critical, since the resulting assembly can simply be held in a horizontal position. However, when the sheathing 10 is installed on the frame F at the construction site, the use of adhesives with special quick curing properties is often desirable. In either case, it is most preferable to use mechanical fasteners, such as nails, staples, or the like, to hold the sheathing 10 in place square on the frame F until the adhesive $A_3$ substantially cures to form the adhesive bond. However, unlike in the past, where mechanical fasteners are often required at frequent intervals (that is every three inches or so) to not only secure the sheathing to the frame, but also to structurally enhance the resulting assembly, the present assembly employing the structurally enhanced sheathing 10 requires only a sufficient number of fasteners to securely hold it in place (for example, every 10 inches (25.40 cm) to 12 inches (30.48 cm) or so). Indeed, instead of permanent mechanical fasteners, the sheathing 10 can simply be held in place by a temporary fastener (for example, a removable clamp) until the adhesive $A_3$ substantially cures. Thus, as a result of this arrangement, it should be appreciated that in a preferred embodiment, the primary racking strength of the wall is produced by the adhesive bond between the structural framing members and the structural insulated sheathing, not the mechanical fasteners.

To manufacture the sheathing 10 of the present invention, the insulating material 14, preferably with the facing 16 already in place, is passed in line and the structural material 14 is applied from a roll (not shown). The adhesive $A_1$ is preferably provided on the structural material 14 on the roll (with or without a backing), and then is activated by applying heat and slight pressure to the assembly thus formed (such as using a hot roller). Of course, it is also possible to use a spray-on adhesive that is applied directly as the two materials are brought into contact with slight pressure.

Figure 6:
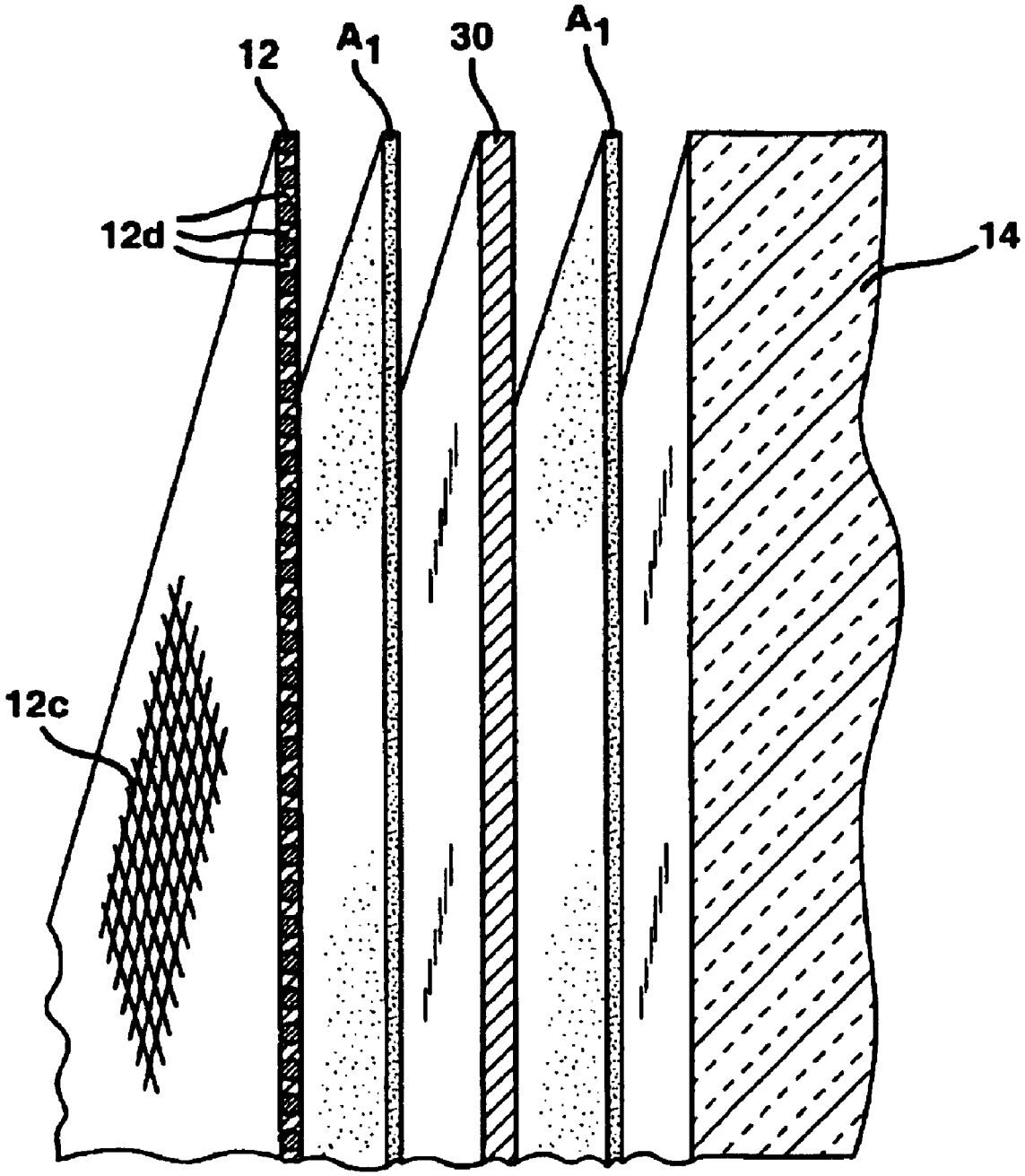
FIG. 6 is a cross-sectional view of one example of a sheathing comprised of a structural material including a stabilizing layer.

Alternatively, and as shown in the cross-sectional view of FIG. 6, is it possible to first attach the fibers or strands 12*al* . . . 12*an* to a separate stabilizing layer 30, such as a thin polymer film, or to separately spray the structural material 12 with a stabilizing compound or the like to form a stabilized layer. The application of the stabilizing layer 30 may occur either during a separate process, or as part of the process of manufacturing the sheathing 10 itself. Adhering the fibers or strands 12*al* . . . 12*an* to this stabilizing layer 30 not only serves to hold them in the proper orientation, but also facilitates attaching the structural layer 12 to the insulating layer 14 during the manufacturing process. For example, an unstabilized glass fabric forming part of the structural material 12 can be adhered to a PET film or an LLDPE film using PVA, a hot melt adhesive, or the like. The opposite side of the film serving as the stabilizing layer 30 may then be adhered to the corresponding surface of the insulation material 14 using a similar type of adhesive (shown as adhesive $A_1$ in FIG. 6). As should be appreciated, this film 30 may also add to the overall racking strength of the sheathing 10.

Experiments conducted under ASTM E72 with a sheathing 10 constructed in accordance with the general principles of the present invention show that the desirable structural enhancement is achieved. The structural material 12 used was manufactured by Burlington Industries, having interwoven strands formed of continuous glass fibers and oriented on the insulation board at a 45 degree double bias relative to a common axis to define a regular grid 12*c*. This material has a weight of 2.5 ounces per square yard (8.5 kilograms per square meter), a tensile strength of 140 psi (965 kPa) in the "machine" direction, a tensile strength of 80 pounds per inch (1428 kilograms per meter) in the "cross machine" direction, elongation of less than 10% at break, and a thickness of approximately 0.0012 inches (0.0030 cm). This structural material 12 was attached to a first face of a one-half inch thick FOAMULAR sheathing panel, with a facing 16 attached to only the substantially planar face on the opposite side. The adhesive $A_2$ used to attach both the facing 16 and the structural material 12 to the insulating material 14 was comprised of either EVA or EVA/PVA copolymers. The structural side of the sheathing 10 was secured to an 8 foot (2.4 meter)×8 foot (2.4 meter) wood frame F using 72 grams of the PROBOND foaming urethane glue per each of the 4 foot (1.2 meter)×8 foot (2.4 meter) boards as adhesive $A_3$, with the strands 12*al* . . . 12*an* formed from the plurality of continuous glass fibers oriented such that the first and second directions $D_1$, $D_2$ are at substantially 45 degrees relative to the vertical axis of the studs V. Roofing nails were placed on twelve inch centers to hold the sheathing 10 in place until the urethane adhesive cured. The frame F was constructed of conventional wood 2 foot (0.61 meter)×4 foot (1.2 meter) substantially as described above, but with a double stud extending vertically at each end as prescribed in the test method.

Figure 7:
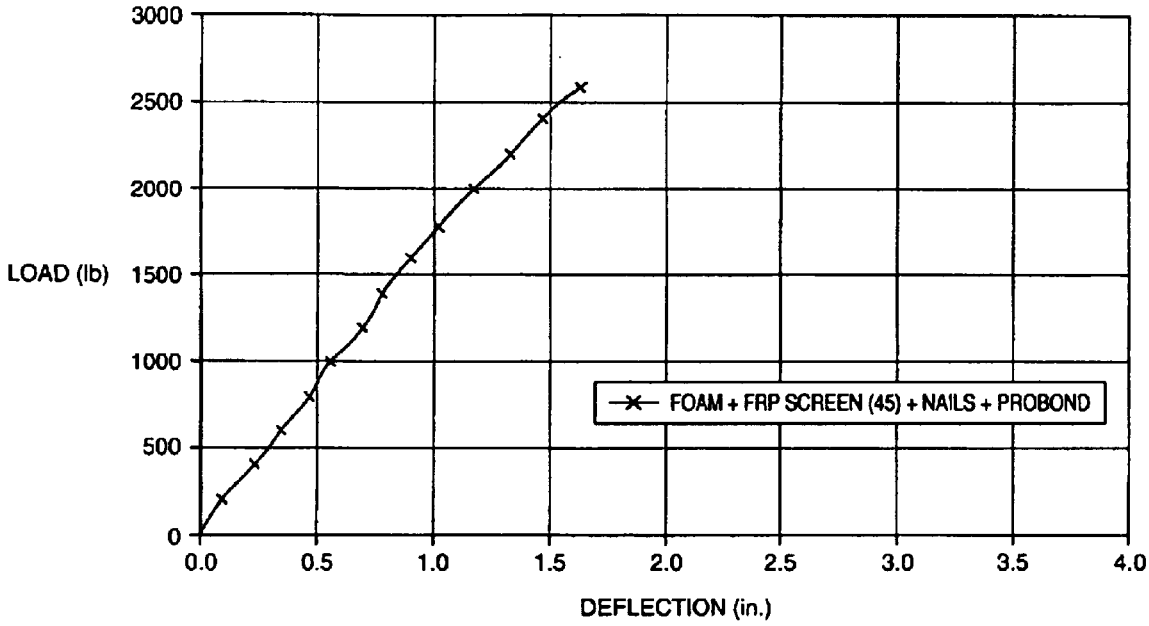
FIG. 7 graphically illustrates the results of a racking strength experiment performed using fibrous structural material.

As demonstrated in numerically in Table 4 below and graphically in FIG. 7, the resulting assembly was able to withstand a shear point load Ls (see FIG. 1), such as that possibly created by wind, of 2600 pound per foot (3869 kilogram per meter) at under 2 inches (5.08 cm) of deflection.

| LOAD (lb.) | DEFLECTION (in.) |
|---|---|
| 0 | 0 |
| 200 | 0.0895 |
| 400 | 0.2335 |
| 600 | 0.345 |
| 800 | 0.464 |
| 1000 | 0.567 |
| 1200 | 0.694 |
| 1400 | 0.7775 |
| 1600 | 0.897 |
| 1800 | 1.024 |
| 2000 | 1.159 |
| 2200 | 1.3165 |
| 2400 | 1.459 |
| 2600 | 1.6395 |

This resulted at least in part from the ability of the low-elongation, double biased strands of fibers forming the structural material 14 to withstand the tensile $L_t$ and compressive $L_c$ loads created as a result of the shear load $L_s$ (see FIG. 1).

The foregoing description has been presented for purposes of illustration and description. It is not intended to be exhaustive or to limit the invention to the precise forms disclosed. Obvious modifications or variations are possible in light of the above teachings. The embodiments were chosen and described to provide the best illustration of the principles of the invention and its practical application to thereby enable one of ordinary skill in the art the utilize the invention in various embodiments and with various modifications as are suited to the particular use contemplated. All such modifications and variations are within the scope of the invention as determined by claims when interpreted in accordance with the breadth to which they are fairly, legally and equitably entitled.

What is claimed is:

1. A sheathing (10) for insulating and structurally enhancing a stable mounting structure, comprising:

a first layer of insulating material (14) having a side edge;

a second layer of structural material (12) attached to said insulating material, said structural material including a plurality of fibers (12*al*–12*an*) extending in first and second biased directions ($D_1$, $D_2$) each defining an acute angle with a line (C) parallel to the side edge and in the same plane as the fibers, wherein said fibers form a grid (12*c*) having a plurality of openings (12*d*) for receiving a first adhesive ($A_3$) for securing the sheathing to the stable mounting structure; and a second adhesive ($A_1$) for attaching said structural material to said insulating material.

2. The sheathing according to claim 1, wherein said insulating material is selected from the group consisting of extruded polystyrene foam, expanded polystyrene foam, polyurethane foam, polypropylene foam, polyisocyanate foam, polyisocyanurate foam, and combinations thereof.

3. The sheathing according to claim 1, wherein said insulating material is selected from the group consisting of wood, paper, waxed cardboard, and combinations thereof.

4. The sheathing according to claim 1, wherein said first and second biased directions are oriented at an included angle of substantially 30 degrees to 60 degrees relative to a common axis the line (C).

5. The sheathing according to claim 1, wherein said first and second directions are double biased at a 45 degree angle relative to the line (C).

6. The sheathing according to claim 1, wherein at least a portion of the fibers are comprised of a material selected from the group consisting of glass fibers, polymer fibers, polymer films or tapes, carbon fibers, natural fibers, mineral fibers, metal, or combinations thereof.

7. The sheathing according to claim 6, wherein the plurality of fibers are divided into a plurality of strands.

8. The sheathing according to claim 1, wherein at least a portion of the fibers are formed of a polymer selected from the group consisting of polyester, nylon, polypropylene, poly-paraphenylene terephthalamide, and other low-elongation polymers.

9. The sheathing according to claim 1, wherein each fiber is comprised of a low-elongation material.

10. The sheathing according to claim 1, wherein at least a portion of the fibers extending in the first direction are interwoven or layered with a corresponding portion of the fibers extending in the second direction.

11. An assembly for insulating and structurally enhancing a building, comprising:

a frame;

a multi-layer sheathing (10) including a first layer of insulating material (14) attached to a second layer of structural material (12), said structural material including a plurality of fibers (12*al*–12*an*) forming a grid (12*c*) having a plurality of openings (12*d*); and an adhesive ($A_3$) for engaging at least a portion of said grid to secure said sheathing to said frame; and a second adhesive ($A_1$) for attaching said structural material to said insulating material.

12. The assembly according to claim 11, wherein the plurality of fibers extend in first and second biased directions ($D_1$, $D_2$).

13. The assembly according to claim 11, wherein said grid is an irregular grid.

14. The assembly according to claim 11, wherein said adhesive is a foaming adhesive capable of at least partially penetrating into said opening in said grid and at least partially filling any gaps in a corresponding frame member.

15. The assembly according to claim 11, wherein said foaming adhesive is a urethane adhesive.

16. The assembly according to claim 11, wherein said adhesive is an adhesive tape capable of at least partially penetrating into the openings in said structural material and at least partially filling any gaps in a corresponding frame member.

17. The assembly according to claim 11, wherein at least some of said fibers are comprised of a material selected from the group consisting of glass fibers, polymer fibers, carbon fibers, natural fibers, mineral fibers, metals, polymer films or tapes, or combinations thereof.

18. The assembly according to claim 11, wherein said plurality of fibers are chopped fibers.

19. The assembly according to claim 11, wherein said first and second directions are double biased at an angle of 45 degrees relative to a common axis.

20. A method of insulating and structurally enhancing a frame, comprising:

providing a multi-layer sheathing (10) including a first layer of insulating material (14) and a second layer of structural material (12), said structural material including a plurality of fibers (12*al*–12*an*) defining a grid (12*c*) having a plurality of openings (12*d*);

attaching the sheathing to the frame with the grid exposed and facing the frame by providing a foaming adhesive ($A_3$) for penetrating at least partially into the openings adjacent to said frame.

21. The method according to claim 20, wherein the foaming adhesive is a quick curing adhesive placed on the frame at a construction site.

22. The method according to claim 20, further including using a plurality of mechanical fasteners or clamps to hold the sheathing in place on the frame while the adhesive cures.

23. The method according to claim 20, wherein said plurality of fibers are double biased at an angle of substantially 45 degrees relative to a common axis, and said method includes orienting the structural insulated sheathing such that the common axis is substantially perpendicular to a horizontal member or parallel to a vertical member of the frame prior to attaching the sheathing to the frame.

* * * * *

UNITED STATES PATENT AND TRADEMARK OFFICE

CERTIFICATE OF CORRECTION

PATENT NO. : 6,715,249 B2
DATED : April 6, 2004
INVENTOR(S) : Rusek

It is certified that error appears in the above-identified patent and that said Letters Patent is hereby corrected as shown below:

Title page,
Item [74], Inventor, "Stanley J. Rusek" should have the suffix "JR" after his name.

Signed and Sealed this

Twenty-fifth Day of May, 2004

JON W. DUDAS
*Acting Director of the United States Patent and Trademark Office*